US006681443B1

(12) United States Patent
Bourgeois

(10) Patent No.: US 6,681,443 B1
(45) Date of Patent: Jan. 27, 2004

(54) BLOWER

(76) Inventor: Michel J. Bourgeois, 1769 Suwanee Valley Rd., Lawrenceville, GA (US) 30043

( * ) Notice: Subject to any disclaimer, the term of this patent is extended or adjusted under 35 U.S.C. 154(b) by 159 days.

(21) Appl. No.: 10/039,543

(22) Filed: Oct. 19, 2001

(51) Int. Cl.[7] ..... E01H 1/08
(52) U.S. Cl. ..... 15/405; 15/340.1
(58) Field of Search ..... 15/316.1, 330, 15/340.1, 340.2, 405

(56) References Cited

U.S. PATENT DOCUMENTS

| | | | | | |
|---|---|---|---|---|---|
| 2,983,057 | A | | 5/1961 | Frickson | |
| 3,863,291 | A | * | 2/1975 | Woelffer | 15/328 |
| 4,118,826 | A | | 10/1978 | Kaeser | |
| 4,187,577 | A | | 2/1980 | Hansen et al. | |
| 4,227,280 | A | | 10/1980 | Comer | |
| 4,237,576 | A | | 12/1980 | Stakes | |
| 4,242,794 | A | | 1/1981 | Peterson | |
| 4,404,706 | A | | 9/1983 | Loyd | |
| 4,461,055 | A | * | 7/1984 | Zerrer et al. | 15/344 |
| 4,679,983 | A | | 7/1987 | Pietryk et al. | |
| 5,107,566 | A | * | 4/1992 | Schmid | 15/338 |
| 5,197,266 | A | | 3/1993 | Kambeitz | |
| 5,203,689 | A | | 4/1993 | Duggan et al. | |
| 5,222,275 | A | * | 6/1993 | Baker et al. | 15/329 |
| 5,294,063 | A | | 3/1994 | Bote | |
| 5,367,739 | A | * | 11/1994 | Johnson | 15/316.1 |
| 5,735,018 | A | * | 4/1998 | Gallagher et al. | 15/405 |
| 5,768,749 | A | * | 6/1998 | Ohi et al. | 15/405 |
| 5,826,416 | A | | 10/1998 | Sugden et al. | |
| 6,073,305 | A | * | 6/2000 | Hesskamp | 15/405 |
| 6,226,833 | B1 | * | 5/2001 | Kawaguchi et al. | 15/405 |
| 6,253,416 | B1 | * | 7/2001 | Lauer et al. | 15/361 |
| 2002/0023310 | A1 | * | 2/2002 | Tomaschewski | 15/320 |

OTHER PUBLICATIONS

Brochure—Venture Products, Inc.—Attachments for the Ventrac 4000—Power Blower—Model KA160.

Venture Products, Inc.—Ventrac—Versatility By Design—2001.

* cited by examiner

*Primary Examiner*—Terrence R. Till
(74) *Attorney, Agent, or Firm*—Womble Carlyle Sandridge & Rice, PLLC

(57) ABSTRACT

A blower having an outlet adjustably movable through a path substantially circumscribing an axis is disclosed. The blower may include an outlet formed in a housing which is coaxially aligned with an impeller. The housing and the impeller may rotate independently about the axis. Adjustable rotation of the housing may be controlled by an actuator, such as an electric motor, which is operably connected to the housing. The blower may include a wheel-mounted frame which supports the impeller and the housing. The blower may be mounted to an implement, such as a lawn mower or a tractor.

14 Claims, 8 Drawing Sheets

BLOWER

BACKGROUND

1. Field of the Invention

The present invention relates generally to assemblies for generating directional air currents. More particularly, the present invention relates to mechanized outdoor implements for blowing debris.

II. Background of the Invention

Blowers are commonly used in outdoor settings to manipulate both natural and man-made debris. Such blowers are commonly configured to generate a current of forced air and directionally control the current. A variety of blower configurations are currently available to provide a portable means for generating and directionally controlling an air current. Current examples of blowers generally fall into one of two categories- operator-propelled and mechanized. The operator-propelled category includes blowers maneuvered by the operator, such as cart-mounted, operator-bome and hand-held blowers. In order to adjust the direction of the air current of blowers in this category, usually either the entire blower or the outlet must be manually moved by the operator. The manual effort required to adjust the current direction during the course of completing a large job is significant. Mechanized blowers may either be attached to a tractor or similar motorized implement or include a self-contained motorized assembly that provides for movement of the blower. As with the operator-propelled blowers, current mechanized blowers must be completely moved, or their outlets manually adjusted, in order to adjust the direction of their air currents. Regardless of the category into which a blower falls, existing blowers generally suffer from the same disadvantages. One of the primary disadvantages is the inadequacy of the range of directional adjustment of the blower outlet. Most blowers provide for no adjustment of the blower outlet, and, of those blowers that do provide outlet adjustment, none provides outlet(s) that are adjustable about a path substantially circumscribing a vertical axis. Outlet adjustment through such a path advantageously allows for more efficient operation of the blower than is otherwise available. Another important disadvantage suffered by existing blowers is a lack of mechanized outlet adjustment. As a result, existing blower outlets must be manually adjusted or else the entire blower must be moved in order to redirect the generated air current.

Consequently, there is a need for a blower that overcomes one or both of these disadvantages as well as others.

SUMMARY

The present invention is directed to a blower for generating a current of fluid, such as air, that is directionally controlled through at least one outlet. The blower outlet, or outlets when viewed in the aggregate, may be adjustable through a path substantially circumscribing a vertical axis. The air current generated by the blower may be adjustably directed through all, or a substantial portion, of a circle radiating from a vertical axis. This directional adjustment of the air current may be accomplished by adjustment of the outlet(s) through a similar arc, or through an alternative non-circular path providing similar range of adjustment. The blower outlet(s) may be located in a housing that is, in part, adjustably movable through such a path. The blower may include a mechanized assembly by which the operator controls the direction of the current of air generated therein. The mechanized assembly may have an actuator operably connected to the outlet(s) and/or housing in order to control their adjustable movement. Such mechanized assemblies may incorporate electrical, hydraulic or other known features to actuate and control the adjustment of the outlet(s). The blower of the present invention may be operator-propelled, self-propelled, or mounted to an implement such as a tractor, mower or the like.

The invention also encompasses a blower comprising an outlet in fluid communication with an impeller for generating a current or jet of fluid, wherein the outlet is adjustably movable through a path substantially circumscribing a vertical axis.

Among aspects encompassed by the invention is a blower assembly including a frame to which is mounted a blower. The blower has an outlet through which a current or jet of air is ejected in a direction away from the blower assembly. The blower assembly also includes an activator coupled to the blower for moving the outlet through a substantially circular path to direct the current of air in a predetermined direction relative to the blower assembly.

The present invention encompasses a blower comprising a housing having an outlet formed therein, wherein at least a portion of the housing including the outlet is adjustably rotatable about a vertical axis.

The present invention further encompasses a blower comprising a housing adjustably rotatable about an axis extending therethrough, and an impeller coaxially aligned with the housing.

A blower of the present invention also may comprise an impeller rotatable about an axis and a housing having an outlet formed therein and containing the impeller, wherein the housing is adjustably rotatable about the axis to direct a flow of air generated by the impeller. Such a blower also includes an actuator operably connected to the housing, wherein the actuator controls adjustable rotation of the housing, and a frame supporting the impeller and the housing.

The present invention additionally encompasses a blower for moving debris comprising an impeller housed in a housing, wherein the impeller is operably connected to a motor. The housing of the blower includes an inlet and an outlet in flow communication with the impeller, the housing and the impeller being coaxially aligned along an axis, and the housing being adjustably rotatable independently of the impeller through substantially all of a circle circumscribing the axis. The blower also includes an actuator operably connected to the housing, wherein the actuator controls adjustable rotation of the housing about the axis, and a frame supporting the impeller, the housing and the actuator, wherein the frame includes a top section connected to a base by a plurality of legs. The frame of the blower is mounted on a plurality of wheels.

Furthermore, the invention encompasses a method of directing a jet or current of air from a blower in a predetermined direction. The method includes the steps of mounting the blower for rotating about a non-horizontal axis and selectively rotating the blower about the non-horizontal axis until the jet of fluid is directed to the predetermined direction.

These and other aspects of the present invention are set forth in further detail herein.

DETAILED DESCRIPTION

Figure 1:
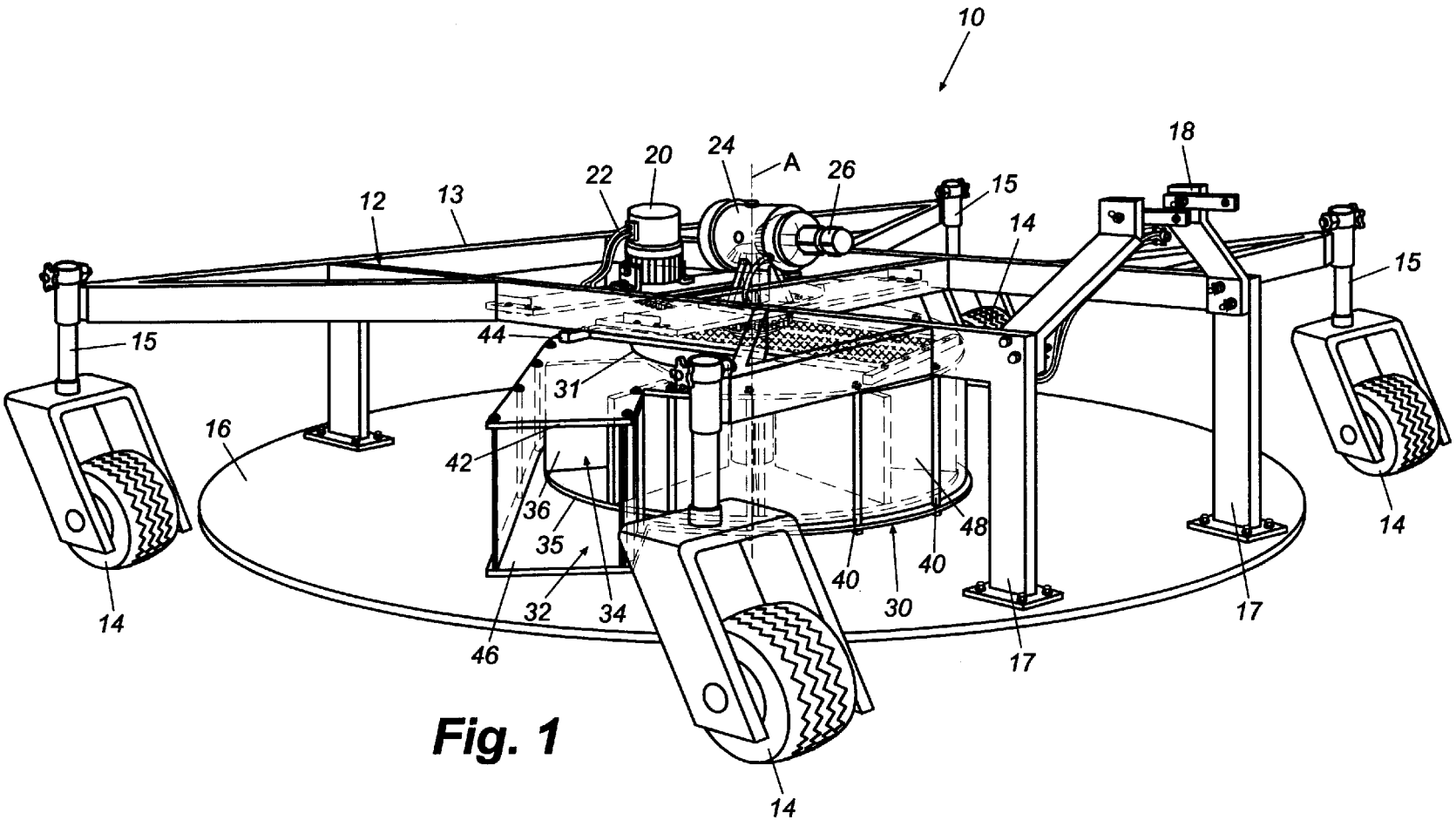
FIG. 1 is a perspective view of a blower that embodies principles of the invention.

Referring now in more detail to the drawings in which like numerals refer where appropriate to like parts throughout the several views, FIG. 1 illustrates a blower that embodies principles of the present invention. The invention includes a blower configured to direct a jet or current of fluid, such as air, outward from a path substantially circumscribing an axis. Among the uses of the blower is the movement of debris, such as for example, grass, leaves, trash, snow, dirt, sand and the like by applying to the debris a current of air generated by the blower. However, the blower is not limited simply to this use. Rather, the blower may be used in any situation where a directional control of a current of fluid is desired.

In general terms, the blower includes a means for generating a current of fluid, such as air, which is in flow communication with one or more outlets that are adjustably movable about an axis. The means for generating a current of fluid may be an impeller, a fan, or similar known device contained within a housing. An outlet may be formed in the housing that is itself adjustably rotatable about an axis to direct or point the outlet in a desired direction. The blower may be used in a generally stationary setting or may be moved by mounting it on an appropriate vehicle. For example, the blower may be mounted on a frame that is attached to an implement such as a tractor, cart, lawn mower or the like. While power may be provided by the implement to which the blower is attached, as contemplated by the embodiments shown in FIGS. 1–7, the present invention also encompasses blowers connected to power sources other than the primary implement motors, such as, for example, auxiliary motors specifically provided to supply power to the blower.

As used herein, the term "vertical axis" refers to an axis that is substantially perpendicular to the surface over which the blower is moved or on which the blower is placed. For example, if the blower of the present invention were positioned over sloped ground, then the vertical axis would be one extending substantially perpendicular to the sloped ground. Thus, the term "vertical axis" encompasses more than simply axes extending perpendicular to the plane of the horizon. Furthermore, both the terms "vertical axis" and "axis," as used herein, refer individually to an axis related to the movement of the blower components, and, therefore, both can encompass an axis that changes in alignment and position through time as the blower is moved.

Also, as used herein, the term "outlet" refers to any aperture, orifice, opening, chute, passage, or similar conduit through which a current of fluid is intended to be directed away from the blower, as well as any supporting structure therefor.

Referring to FIG. 1, the blower 10 includes an impeller 34 disposed within a housing 30, both of which are supported by a frame 12. The frame 12 includes an upper frame or top section 13 that has an arrangement of support beams and a deck or platform all of which rest upon a plurality of legs 17. The legs 17 are connected to a base 16. The frame 12 includes one or more wheel mounts 15 connecting one or more wheels 14 to the top section 13. The wheels 14 facilitate movement of the entire blower 10. The wheels 14 may be mounted on castor-type wheel mounts 15 in order to enhance the mobility of the blower 10. Depending upon the intended means for transporting the blower 10, the frame 12 may be connected to a hitch 18, whereby the blower 10 may be attached to an implement such as a tractor (not shown).

The frame 12 supports a gear box 24, an actuator 20, the housing 30 and the impeller 34. The gear box 24 is typically connected to a power source, such as a power-take-off shaft of a tractor (not shown) to which the blower 10 may be mounted. This connection may be had through the coupler 26, which operably connects the gears contained in the gear box 24 to the shaft or shaft extension (not shown). The actuator 20 is operably connected to the outlet 32 which is formed in the housing, so that the actuator may control the adjustable movement of the outlet 32. As shown in FIG. 1, the actuator 20 is operably connected to the housing 30 in which outlet 32 is formed. The actuator 20 may include an electric motor that drives a chain 28 operably connected to the housing 30. Alternatively, the actuator may be pneumatically operated so that operator engagement of the actuator 20 results in the control of the adjustable movement of the outlet 32 and/or the housing 30, i.e. in rotation of the housing. A control line 22 leads to the actuator 20 from a point where the line is conveniently positioned for operator manipulation. However, any appropriate known control system may be used to provide operator-control of the actuator 20. The actuator 20 may be mounted on the top section 13 of the frame 12, as shown in FIG. 1, or in any other appropriate location. Indeed, the actuator 20 may be operably connected to the outlet 32 and/or the housing 30, even though it is mounted away from the frame 12.

FIG. 1 shows the housing 30 of the blower 10 positioned between the base 16 and the top section 13 of the frame 12. The impeller 34 is housed within housing 30 and is coaxially aligned therewith. The impeller 34 is a so-called squirrel cage fan and includes an impeller base 35 and a plurality of blades 36. Rotation of impeller 34 generates a current of air, which is directed out from the housing 30 through outlet 32. As shown in FIG. 1, the outlet 32 is generally a chute that is in flow communication with both the interior of housing 30 and impeller 34. Housing 30 also includes an inlet 31 through which ambient air is drawn. This ambient air makes up the current of air generated by the impeller. In the illustrated embodiment, the housing 30 includes a top portion 42, a side portion 48, a bottom portion 46 and a plurality of support rods 40. These parts of the housing 30 are put together in order to form an inner chamber wherein the current of air is generated. This inner chamber is in flow communication with the inlet 31 and with the outlet 32. The outlet 32 may include a chute 33 formed by the portions of the housing 30. The chute 33 of the outlet 32 may extend tangentially from the housing 30 in order to provide an exit for the forced current of air generated therein.

Figure 2A:
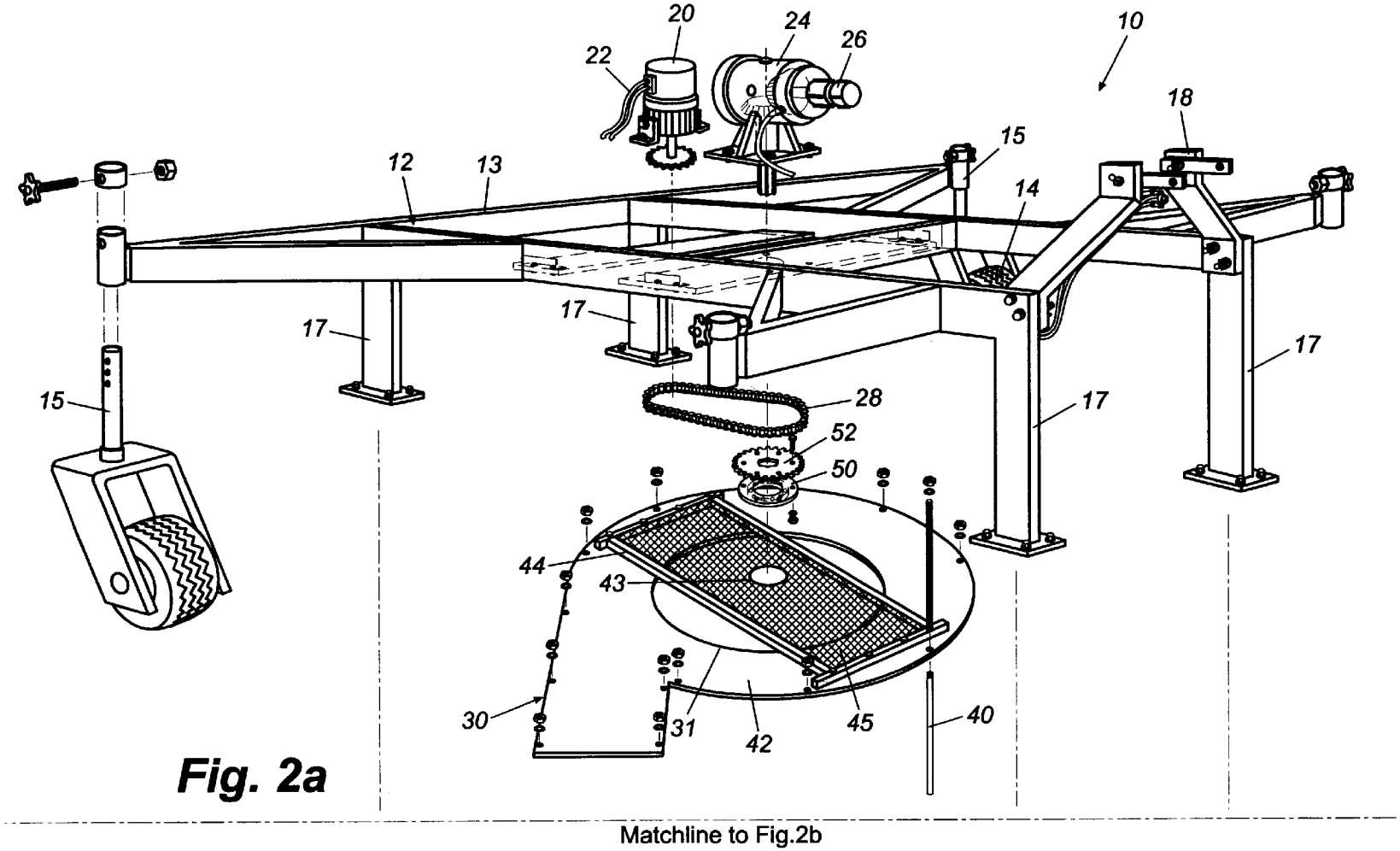
FIG. 2*a* is an exploded view of a portion of the blower of FIG. 1.

As shown in FIGS. 1 and 2*a,* in this embodiment of the blower 10, the housing 30 is supported in part by a stabilizer bracket 44. The stabilizer bracket 44 is connected to a section of the housing 30, in this case the top portion 42, by conventional fasteners, such as, for example, screws. The stabilizer bracket 44 also is connected to upper flange bearing 50 by appropriate fasteners. The stabilizer bracket 44 includes a mesh 45 that allows passage of ambient air into the inlet 31 of housing 30. An aperture 43 is provided in the stabilizer bracket 44 so that shaft extension 56, shown in FIG. 4, may extend therethrough.

Figure 3:
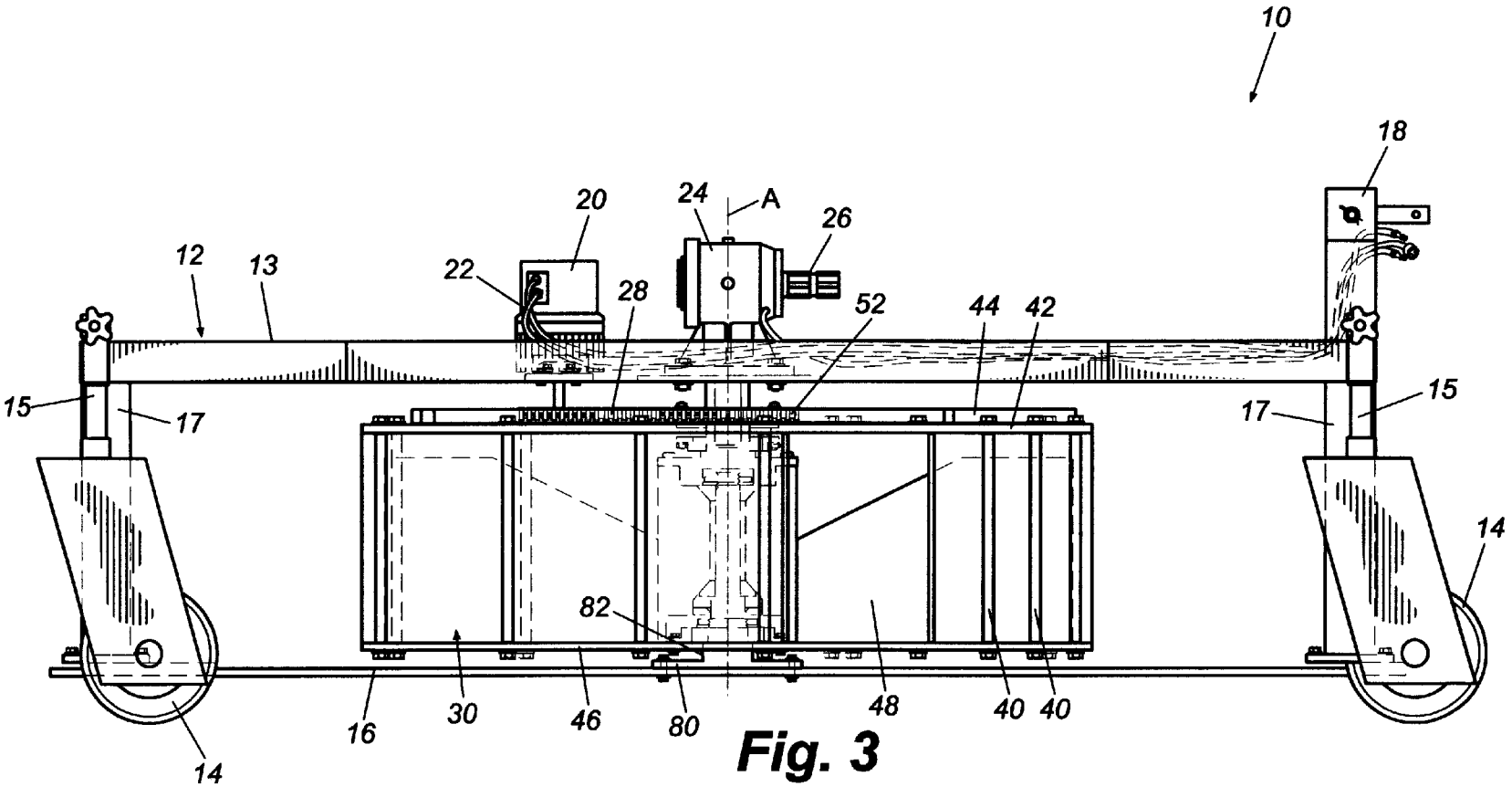
FIG. 3 is a side view of the blower of FIG. 1.
Figure 4:
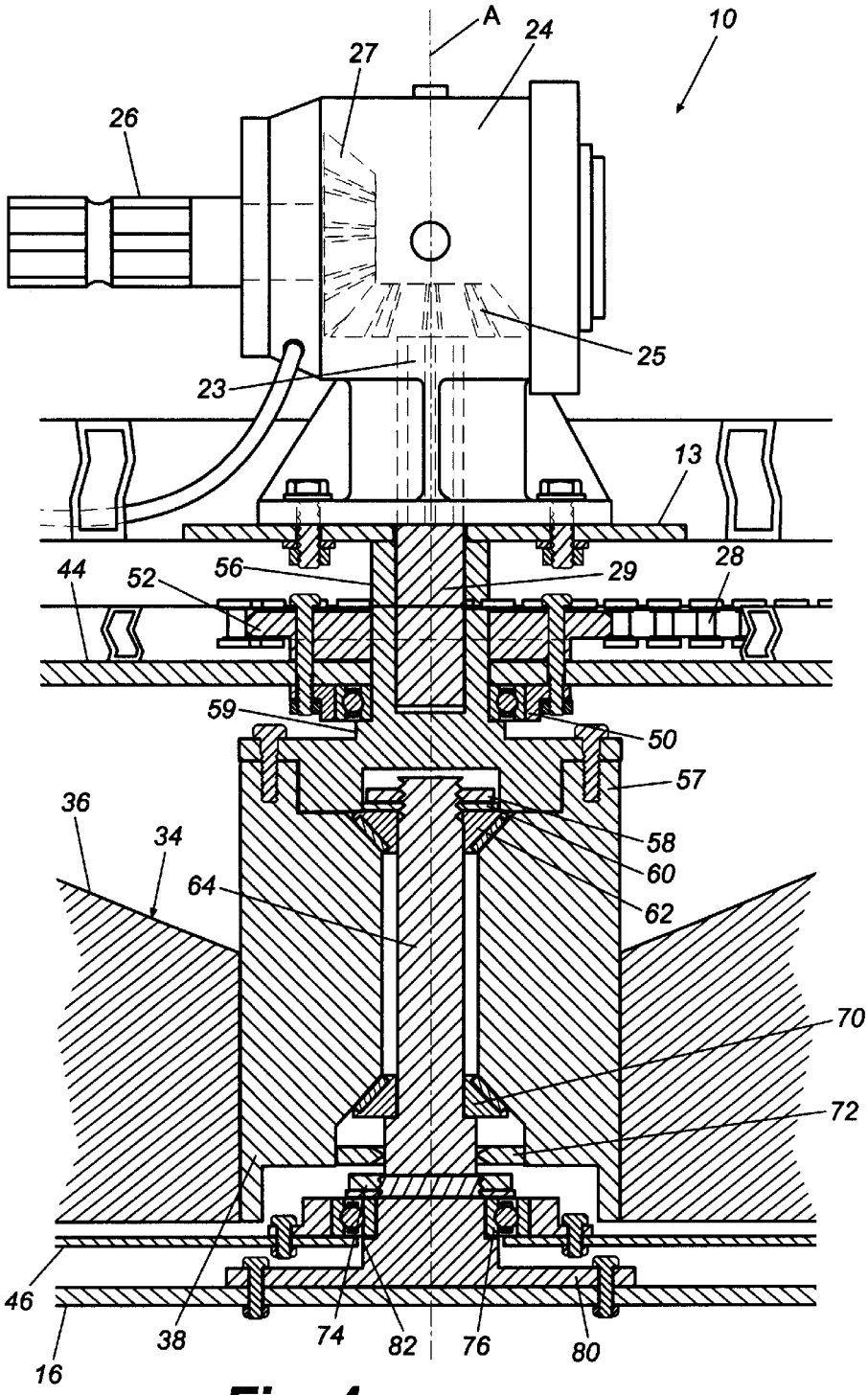
FIG. 4 is a cross-sectional view of a portion of the blower of FIG. 1.

The blower 10 is designed such that the housing 30 may be adjustably moved or rotated about axis A, shown in FIGS. 1, 3 and 4, independently of impeller 34, which also rotates about axis A. Since outlet 32 is formed in housing 30, outlet 32 also is adjustably movable about axis A along with the housing. As shown in FIG. 3, axis A extends generally through the center of blower 10 in a position that is generally perpendicular to a surface upon which blower 10 is placed.

Figure 2B:
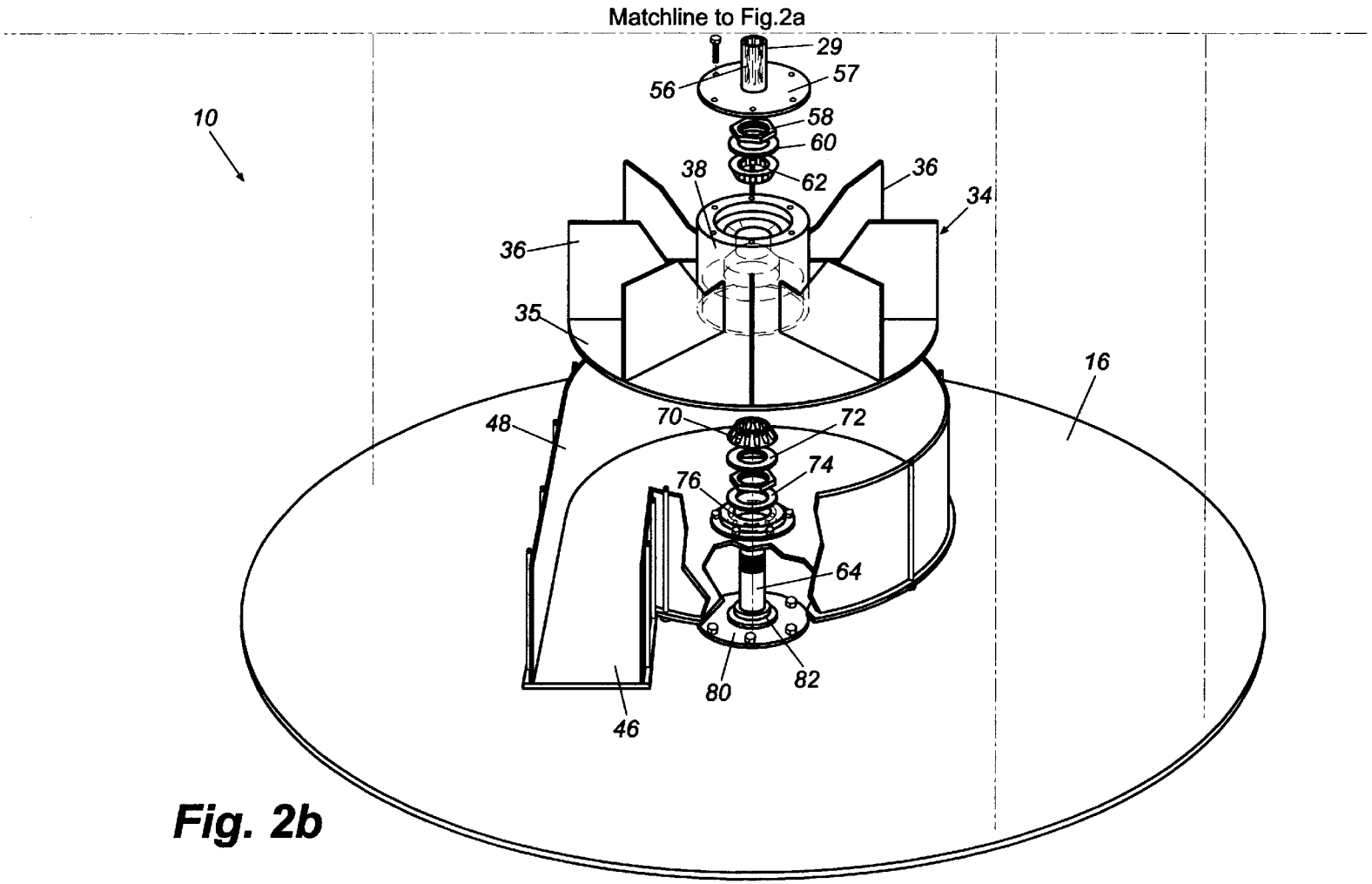
FIG. 2*b* is an exploded view of another portion of the blower of FIG. 1.

As shown in FIGS. 2*a*, 2*b* and 4, gear box 24 includes a first gear 27 that is operably connected to coupler 26. First gear 27 cooperates with at least one second gear 25 in order to redirect the mechanical advantage provided through connection of coupler 26 to the power-take-off shaft of a tractor to which blower 10 is hitched. In addition to first and second gears 27 and 25, gearbox 24 may include other known components necessary for operation of the blower 10. While power is directed, in this embodiment, from the power-take-off shaft of the implement to which the blower 10 is attached through the gearbox 24, the present invention also contemplates other mechanisms for transmitting power to the blower 10, such as, for example, the use of a belt-and-pulley system in place of, or in conjunction with, the gear box 24.

Returning to FIGS. 2*a*, 2*b* and 4, the second gear 25 is connected to a male spline 23 extending downward out of the gearbox 24. The male spline 23 mates with a female spline 29 axially aligned within the shaft extension 56. Upper flange bearing 50 cooperates with the shaft extension 56 and rests upon a shoulder 59 extending therefrom. The upper flange bearing 50 is fastened to both a sprocket 52 and the stabilizer bracket 44 by any conventional means, such as, for example, one or more nuts and bolts. The sprocket 52 is connected to actuator 20 by a belt or chain 28. Activating the actuator 20 thereby moves the chain 28, which, in turn, rotates the sprocket 52 about the shaft extension 56. The sprocket 52, in turn, also rotates the stabilizer bracket 44 about the shaft extension 56. The upper flange bearing 50 facilitates the smooth rotation of the stabilizer bracket 44. As the stabilizer bracket 44 rotates upon the upper flange bearing 50 about the shaft extension 56, the housing 30 also rotates due to its connection to, and support by, the stabilizer bracket 44. The combination of the sprocket 52, stabilizer bracket 44 and housing 30 may be rotated clockwise and/or counterclockwise by appropriate activation of the actuator 20. This rotation may be adjustably controlled so that the combination may be placed in the desired orientation. Multiple or single rotation of this combination about the shaft extension, and axis A extending therethrough, in either a clockwise and/or counterclockwise direction is contemplated.

As shown in FIGS. 2*b* and 4, the impeller 34 includes a plurality of blades 36 connected to a hub 38 and impeller base 35. The hub 38 is connected to the flange 57 of the shaft extension 56 by one or more fasteners. The hub 38 is axially aligned with a main shaft 64, which is longitudinally aligned along axis A, as is shaft extension 56. The hub 38 rotates about the main shaft 64 by cooperation with upper and lower tapered bearings 62 and 70 respectively, which are also axially aligned with the main shaft 64. The main shaft 64 is connected to the upper tapered bearing 62 by a conventional fastener, such as a locknut 58 and washer 60 assembly threaded upon the top end of the main shaft, and supports the lower tapered bearing 70 by a shoulder 63 formed therein. The blades 36 extend radially outward from the hub 38 and are supported by a impeller base 35 extending from a lower portion of the hub 38. A grease seal 72 is axially aligned between the shoulder 63 of the main shaft 64 and the hub 38 in order to facilitate the smooth rotation of the impeller 34. A lower flange bearing 76 is axially aligned upon the main shaft 64 below the hub 38 of the impeller 34 and rests upon a second shoulder 82 of the main shaft 64. The lower flange bearing 76 may be secured in position by a second locknut and washer combination 74 threaded upon the main shaft 64.

The bottom portion 46 of the housing 30 is connected to the lower flange bearing 76 by a plurality of fasteners, such nuts and bolts. The upper and lower flange bearings 50 and 76 are both aligned along axis A extending through the shaft extension 56 and the main shaft 64. Such alignment facilitates the rotation of the housing about the same axis A.

When power is transmitted through the coupler 26 to the gears 27 and 25 in the gearbox 24, gear 27 turns gear 25, which, in turn, turns shaft extension 56, due to the mating of male spline 23 with female spline 29 which is formed in shaft extension 56. Shaft extension 56 in turn rotates hub 38 of impeller 34. The hub 38 rotates about the main shaft 34 and is facilitated by the cooperation with tapered bearings 62 and 70. As hub 38 rotates, blades 36 rotate, thereby drawing air into the chamber of housing 30 and generating a current of air which may then be directed from the blower 10 through outlet 32.

The main shaft 64 includes a shaft flange 80 extending from a lower portion thereof. The main shaft 64 is mounted to a base by fasteners connecting the shaft flange 80 to the base 16 of the frame 12.

Figure 5:
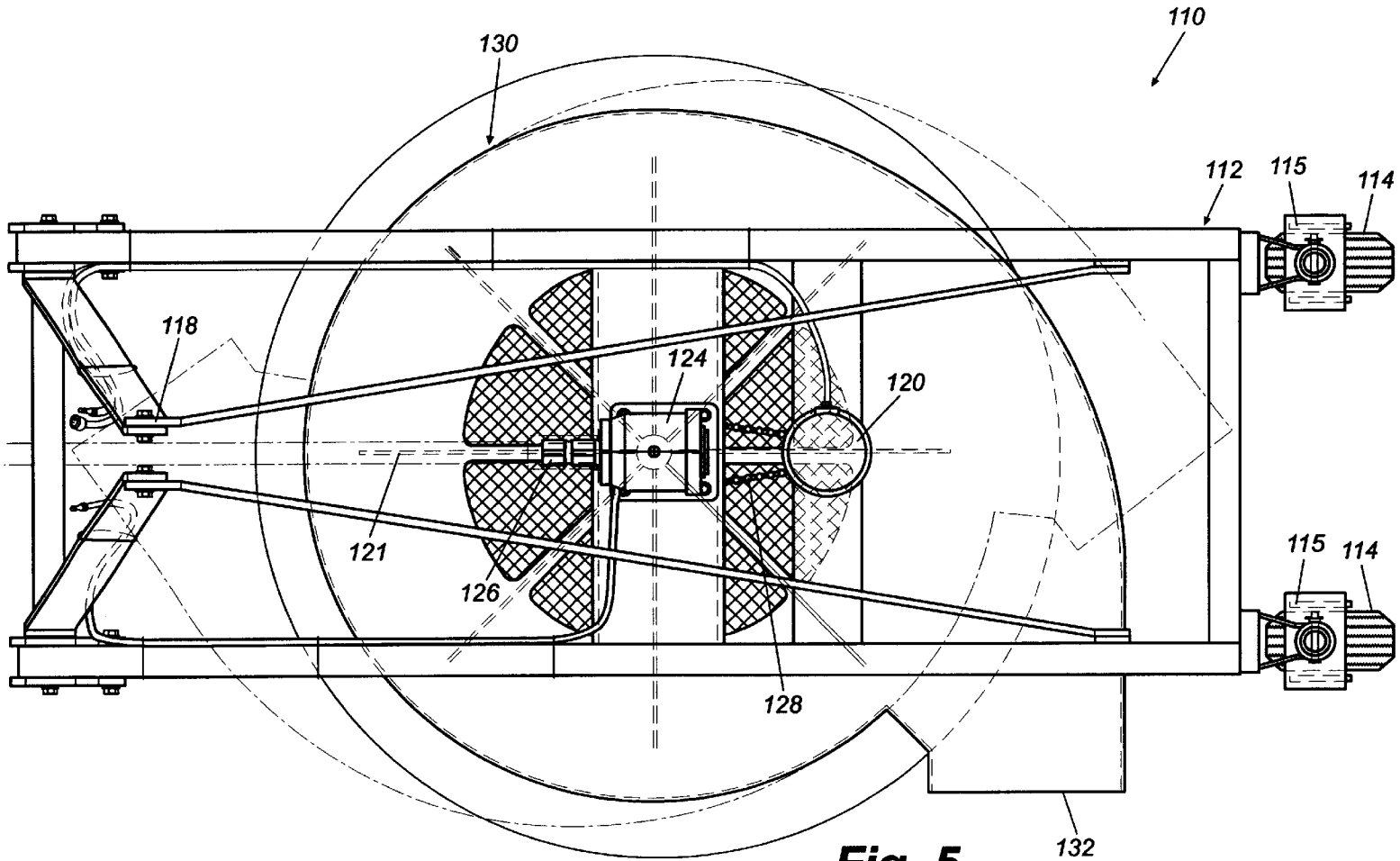
FIG. 5 is a top view of another embodiment of a blower embodying principles of the invention.
Figure 6:
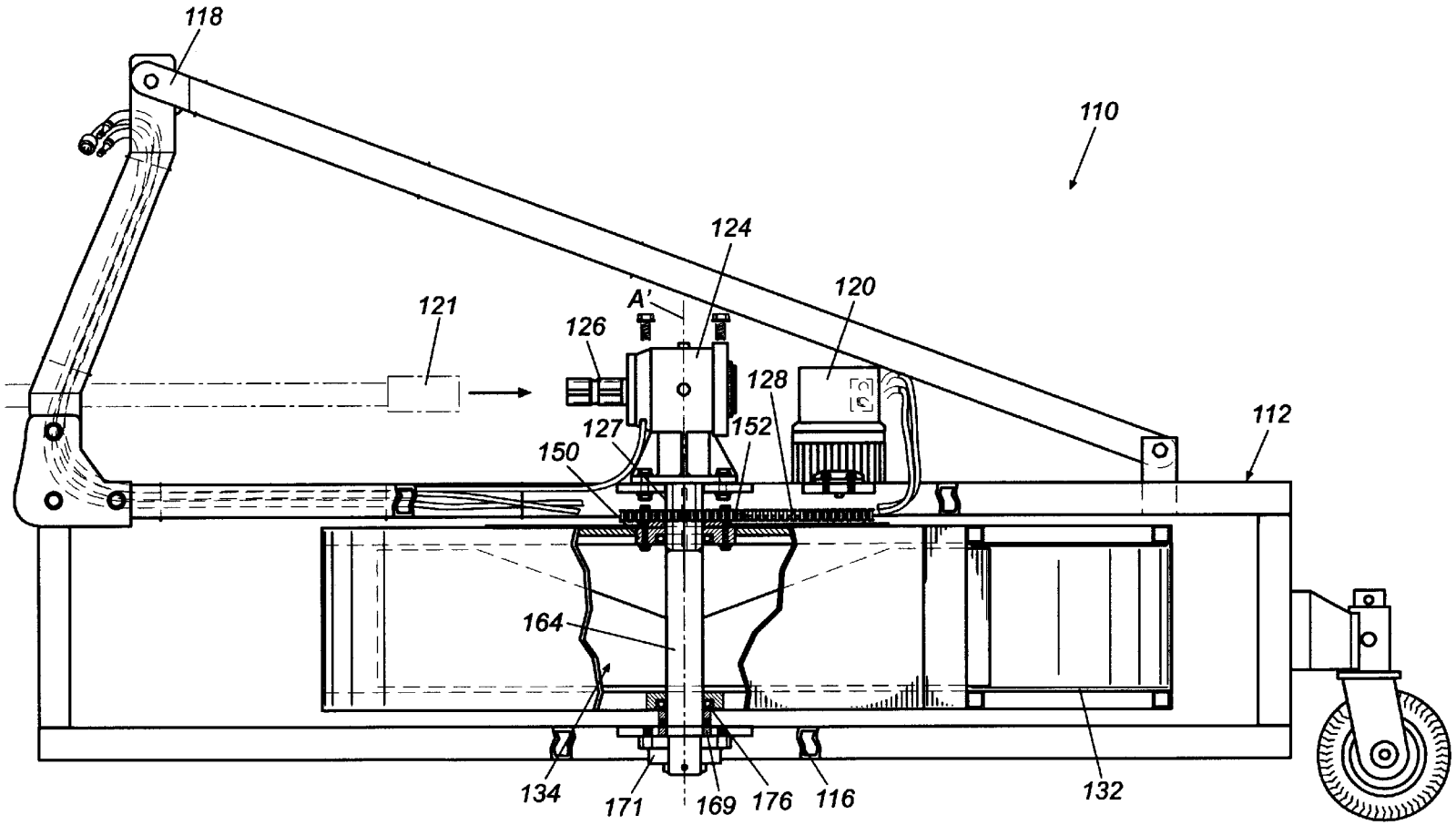
FIG. 6 is a side view of the blower of FIG. 5 with a portion cut away.

Another embodiment of a blower 110 embodies principles of the present invention is shown in FIGS. 5 and 6. Similar to the previous embodiment, this embodiment of the blower includes an impeller enclosed in a housing supported by a frame, which is mountable to an implement, such as a tractor, and which may be supported on wheels attached thereto. Also, as with the previous embodiment, the impeller and the housing of this embodiment are independently rotatable about an axis. Furthermore, the rotation of the housing is adjustably controlled by the operator through an actuator connected to a motor. Actuation may be through hydraulic, electrical or other known means. However, unlike the previous embodiment, the shaft of the blower is rotatable.

Blower 110 includes a frame 112 supporting an impeller 134 and a housing 130. As in blower 10 of the first embodiment, the housing 130, with outlet 132 formed therein, and the impeller 134 of blower 110 are all movable about an axis A'. As shown in FIG. 5 in phantom line, housing 130 is rotatable about axis A' extending through the center thereof. Rotation of housing 130 provides for adjustable movement of outlet 132 in order to provide for the directional control of a current of air generated by the blower 110. Unlike the previous embodiment, the frame 112 of blower 110 includes only two wheels 114 connected to the frame 112 by wheel mounts 115. Hitch 118 extends from the frame 112 generally above the remainder thereof in order to provide for a higher attachment point of the blower 110 to an implement. As in the previous embodiment, blower 110 includes a gearbox 124 having a coupler 126 connected thereto. As shown in phantom line in FIG. 6, a power-take-off shaft 121 of a tractor may be connected to the coupler 126 in order to provide power to the blower 110. However, unlike the previous embodiment, the gears (not shown) contained in the gearbox 124 turn the shaft 164. The shaft 164 is operably connected to the gears of the gearbox 124 and extends down to set in a coupling 171 formed in base 116. A shaft flange bearing 169 cooperates with the shaft and the base in order to provide for the smooth rotation of the shaft 164. The impeller 134 is attached to the shaft 164 and rotates therewith. Thus, when power is directed to the shaft 164, the impeller 134 also moves.

As in the previous embodiment, the adjustable rotation of housing 130 of blower 110 is controlled by an actuator 120. Actuator 120 is operably connected to the housing 130 and the outlet 132 formed therein by a chain 128. Chain 128 engages a sprocket 152 that is coaxially aligned with shaft 164. Sprocket 128 is connected to flange bearing 150, which cooperates with shaft 164, and housing 130. A second flange bearing 176 also cooperates with shaft 164 and the lower portion of housing 130 in order to stabilize housing 130 as it rotates about shaft 164. Therefore, when chain 128 rotates sprocket 152 then housing 130 also rotates about axis A' which extends through shaft 164.

Figures 7A, 7B:
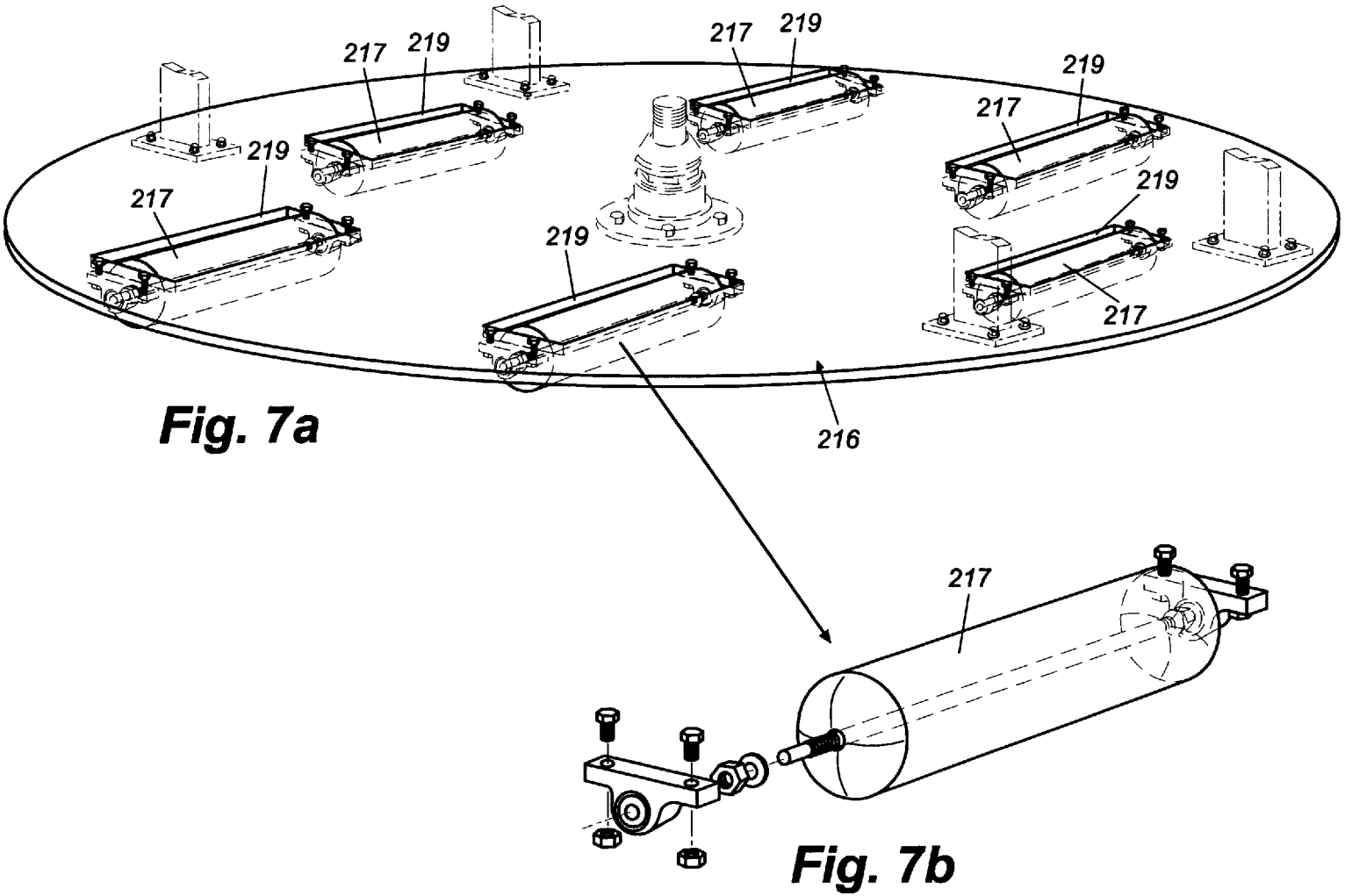
FIG. 7*a* is a perspective view of the base of another embodiment of a blower embodying principles of the present invention.
FIG. 7*b* is a perspective view of a roller assembly of the base of FIG. 7*a*.

Another embodiment of the base of the frame is shown in FIGS. 7*a* and 7*b*. Base 216 includes one or more rollers 217 attached thereto. Rollers 217 are positioned in slots 219 so that their axes of rotation generally extend horizontally through the base 216, thereby reducing the clearance of the base over the surface upon which the blower is drawn. Rollers 217 may be used on a blower that is used in areas where damage to the surface over which the blower moves is to be avoided. For example, such a roller configuration would allow the use of a blower on golf course fairways and greens, which may be easily damaged by larger wheels.

Among the aspects encompassed by the present invention is a blower comprising an outlet adjustably movable through a path substantially circumscribing a vertical axis. The path may be disposed along a circle coaxially aligned with said vertical axis. Such a blower may include an acutator operably connected to the outlet, wherein the actuator controls adjustable movement of the outlet through the path. The actuator may include an electric motor. The blower may further include a housing having the outlet formed therein, wherein the housing is adjustably movable about the vertical axis. Also, the blower may include an impeller for generating a current of fluid, is coaxially aligned with the housing, wherein the impeller rotates independently of the housing about said vertical axis. The impeller is in flow communication with the outlet. The blower may also include a frame supporting the housing and the impeller. The frame, including a top section connected to a base by a plurality of legs, is mounted on a plurality of wheels, and the top section is connected to a hitch. Furthermore, the frame of the blower may be such that the base includes a roller attached thereto.

The present invention also includes a blower comprising a housing having an outlet formed therein, wherein at least a portion of the housing, including the outlet, is adjustably rotatable about a path substantially circumscribing an axis coaxially aligned with the housing. In such case, the blower may further include an impeller coaxially aligned with the housing. Futhermore, the blower may include an actuator operably connected to the portion of the housing including the outlet, wherein the actuator controls adjustable rotation of the portion. The actuator may include an electric motor. Alternatively, the actuator may be pneumatically operated. The blower may further include a frame supporting the housing, wherein the frame is mounted on a plurality of wheels. The frame may be connected to a hitch.

The invention further includes a blower comprising a housing adjustably rotatable about an axis extending therethrough, and an impeller coaxially aligned with the housing. In such case, the blower may also include an actuator operably connected to the housing, wherein said actuator controls adjustable rotation of the housing. Such a blower having an actuator may be such that the actuator includes an electric motor. Alternatively, this type of blower may include an actuator that is pneumatically operated. The housing of such a blower may include an outlet formed therein, wherein the outlet is in flow communication with the impeller. Additionally, the blower may further include a frame supporting the housing and the impeller, wherein the frame is wheel-mounted. Also, the housing of this blower may be such that it is adjustably rotatable through substantially all of a circle circumscribing the axis.

A blower of the present invention also may comprise an impeller rotatable about an axis; a housing having an outlet formed therein, the housing being adjustably rotatable about the axis; an actuator operably connected to the housing, wherein the actuator controls adjustable rotation of the housing; and, a frame supporting the impeller and the housing. In such a blower, the actuator may be pneumatically operated. Alternatively, the actuator may include an electric motor. The impeller of such a blower may be operably connected to a power-take-off shaft of an implement. In such a case, the implement may be selected from a tractor and a mower. Furthermore, the housing may be adjustably rotatable through substantially all of a circle circumscribing the axis.

The present invention additionally encompasses a blower for moving debris comprising an impeller housed in a housing, the impeller being operably connected to a motor, the housing including an inlet and an outlet in flow communication with the impeller, the housing and the impeller being coaxially aligned along an axis, the housing being adjustably rotatable independently of the impeller through substantially all of a circle circumscribing the axis, an actuator operably connected to the housing, wherein the actuator controls adjustable rotation of the housing about the axis and, a frame supporting the impeller, the housing and the actuator, the frame including a top section connected to a base by a plurality of legs, the frame being mounted on a plurality of wheels.

A method of directing a jet or current of fluid from a blower in a predetermined direction is also encompassed by the present invention. The method includes the step of mounting the blower for rotation about a non-horizontal axis and the step of selectively rotating the blower about the non-horizontal axis until the jet of fluid is directed in the predetermined direction.

While certain of the embodiments of the present invention have been disclosed herein, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims. Additionally, while it is intended that the scope of the present invention also include various alternate embodiments, it should be understood that each of the embodiments disclosed herein includes features and characteristics which are considered independently inventive. Accordingly, the disclosure of variations and alterations expressed in alternate embodiments is intended only to reflect on the breadth of the scope of the present invention without suggesting that any of the specific features and characteristics of the embodiments are in any way obvious or unimportant.

What is claimed is:

1. A blower comprising:

an outlet in fluid communication with an impeller for generating a current of fluid, wherein said outlet is adjustable movable through a path substantially circumscribing a vertical axis, and further including an acutator operably connected to a housing in which said outlet is formed, wherein said actuator controls the adjustable movement of said outlet through said path.

2. The blower of claim 1, wherein said actuator includes an electric motor.

3. A blower comprising:

an outlet in fluid communication with an impeller for generating a current of fluid, wherein said outlet is adjustably movable through a path substantially circumscribing a vertical axis, a housing having said outlet formed therein, wherein said impeller is disposed within said housing, wherein said impeller is coaxially aligned with said housing, said impeller being rotatable independently of said housing about said vertical axis, and a frame supporting said housing and said impeller, said frame including a top section connected to a base by a plurality of legs, said frame being mounted on a plurality of wheels, said top section being connected to a hitch.

4. A blower comprising:

an outlet in fluid communication with an impeller for generating a current of fluid, wherein said outlet is adjustably movable through a path substantially circumscribing a vertical axis, a housing having said outlet formed therein, wherein said impeller is disposed within said housing, wherein said impeller is coaxially aligned with said housing, said impeller being rotatable independently of said housing about said vertical axis, and a base including a roller attached thereto.

5. A blower comprising:

a housing having an outlet formed therein, wherein at least a portion of said housing, including said outlet, is adjustably rotatable about a path substantially circumscribing an axis coaxially aligned with said housing, and an actuator operably connected to said portion of said housing including said outlet, wherein said actuator controls adjustable rotation of said portion and is pneumatically operated.

6. A blower comprising:

a housing having an outlet formed therein, wherein at least a portion of said housing, including said outlet, is adjustably rotatable about a path substantially circumscribing an axis coaxially aligned with said housing, and a frame supporting said housing, wherein said frame is mounted on a plurality of wheels.

7. The blower of claim 6, wherein said frame is connected to a hitch.

8. A blower comprising:

a housing adjustable rotatable about an axis extending therethrough, and an impeller coaxially aligned with said housing, and an actuator operably connected to said housing, wherein said actuator controls adjustable rotation of said housing and is pneumatically operated.

9. A blower comprising:

a housing adjustably rotatable about an axis extending therethrough, and an impeller coaxially aligned with said housing, and a frame supporting said housing and said impeller, wherein said frame is wheel mounted.

10. A blower comprising:

an impeller rotatable about an axis;

a housing having an outlet formed therein, said housing being adjustably rotatable about said axis;

an actuator operably connected to said housing, wherein said actuator controls adjustable rotation of said housing and is pneumatically operated; and a frame supporting said impeller and said housing.

11. A blower comprising:

an impeller rotatable about an axis, wherein said impeller is operably connected to a power-take-off shaft of an implement;

a housing having an outlet formed therein, said housing being adjustably rotatable about said axis;

an actuator operably connected to said housing, wherein said actuator controls adjustable rotation of said housing; and a frame supporting said impeller and said housing.

12. The blower of claim 11, wherein the implement is selected from a tractor and a mower.

13. A blower comprising:

an impeller rotatable about an axis;

a housing having an outlet formed therein, said housing being adjustable rotatable about said axis, and wherein the housing is adjustably rotatable through substantially all of a circle circumscribing said axis;

an actuator operably connected to said housing, wherein said actuator controls adjustable rotation of said housing; and a frame supporting said impeller and said housing.

14. A blower for moving debris comprising:

an impeller housed in a housing, said impeller being operably connected to a motor, said housing including an inlet and an outlet in flow communication with said impeller, said housing and said impeller being coaxially aligned along an axis, said housing being adjustably rotatable independently of said impeller through substantially all of a circle circumscribing said axis;

an actuator operably connected to said housing, wherein said actuator controls adjustable rotation of said housing about said axis; and a frame supporting said impeller, said housing and said actuator, said frame including a top section connected to a base by a plurality of legs, said frame being mounted on a plurality of wheels.

* * * * *